US005476399A

United States Patent [19]

Porter

[11] Patent Number: 5,476,399

[45] Date of Patent: Dec. 19, 1995

[54] HIGH FREQUENCY/LOW TEMPERATURE ELECTRONIC SOCKET PIN

[75] Inventor: Warren W. Porter, Escondido, Calif.

[73] Assignee: AT&T Global Information Solutions Company, Dayton, 0H

[21] Appl. No.: 247,161

[22] Filed: May 20, 1994

[51] Int. Cl.[6] ..... H01R 13/187

[52] U.S. Cl. ..... 439/843; 439/851

[58] Field of Search ..... 439/842, 843, 439/849, 850, 851–856, 861, 862, 80–82, 638, 651, 825, 826

[56] References Cited

U.S. PATENT DOCUMENTS

| | | | |
|---|---|---|---|
| 1,009,358 | 11/1965 | Fountain . | |
| 3,654,595 | 4/1972 | Curr | 339/256 R |
| 3,760,340 | 9/1973 | Friend | 339/262 R |
| 3,781,770 | 12/1973 | Mancini | 339/259 R |
| 4,447,110 | 5/1984 | Punako et al. | 339/262 RR |
| 4,534,603 | 8/1985 | Brown et al. | 439/82 |
| 4,797,113 | 1/1989 | Lambert | 439/82 |
| 4,867,709 | 9/1989 | Molitor et al. | 439/675 |
| 4,894,031 | 1/1990 | Damon et al. | 439/82 |

*Primary Examiner*—David L. Pirlot
*Attorney, Agent, or Firm*—James M. Stover

[57] ABSTRACT

An electronic socket pin for use with sub-cooled integrated circuit devices. The socket pin design provides lower thermal conductance and electrical signal path resistance than a traditional electronic socket pin. The improved socket pin has a tubular body formed of an electrically conductive material having a low thermal conductance, such as 304 stainless steel. The tubular body is open at one end, and has a first diameter at the open end, for receiving an integrated circuit device signal lead. The remainder of the length of the tubular body has a second diameter which is much narrower than the first diameter. This narrower cross section further reduces the thermal conductance of the electronic socket pin. A contact sleeve having a cylindrical body including radially inwardly extending, resilient, prongs formed into the wall of the sleeve is fitted over the open end of the electronic socket pin. When fitted over the end of the socket pin, which includes several longitudinal slots formed into the wall of the socket pin, the prongs extend through the slots for engaging an inserted signal lead. The prongs are attached to the lower section of sleeve, away from the open end of the electronic socket pin.

8 Claims, 4 Drawing Sheets

HIGH FREQUENCY/LOW TEMPERATURE ELECTRONIC SOCKET PIN

The present invention relates to electronic socket pin connectors and, more particularly, to a socket pin connector mounted to a printed circuit board for removably receiving leads from an integrated circuit device to be mounted to the board.

BACKGROUND OF THE INVENTION

Socket pin connectors, for removably connecting integrated circuit (IC) devices to a printed circuit board, are often fabricated from lathe turned brass with formed spring contact sleeves fitted inside of a recess in the top of the pin connector. FIG. 1 provides a longitudinal sectional view of a typical prior art pin connector including a brass body 10, a recess 12 provided in the top end of the connector body, and a formed spring contact 14 fitted into recess 12. The contact sleeve 14 serves as a receptacle for a signal lead 16 of an integrated circuit device 18. A typical prior art brass socket pin, such as is shown in FIG. 1, has a length of 0.5 inches and an internal diameter (I.D.) of 0.035 inches at the socket end, tapering to 0.02 inches in outside diameter (O.D.) at the soldered end. The thermal resistance of a typical brass socket pin, as described above, is approximately 1000° C. per watt.

Many high-density integrated circuit devices, such as the latest and upcoming generations of central processor units (CPUs) utilized in present computer systems or planned for use in future computer systems, require cooling to improve performance or to prevent damage from the high temperatures generated by these devices. Unfortunately, when an integrated circuit component, such as a programmable gate array (PGA) CPU, is cooled substantially below 0° Celsius it becomes susceptible to the collection of condensation in the form of frost which may cause damage to other circuit components accompanying the integrated circuit. The integrated circuit must therefore be insulated from the ambient environment. When the integrated circuit being cooled is installed into a socket which is soldered to a printed circuit board, the pins of the socket will also precipitate frost unless they are otherwise protected. A socket pin design providing increased thermal resistance, without a reduction in electrical signal conductance or operating performance, for use with subcooled electrical components is desired.

OBJECTS OF THE INVENTION

It is therefore an object of the present invention to provide a new and useful socket pin for electrical connection of an electronic component to a printed circuit board.

It is another object of the present invention to provide such a socket pin having an increased thermal resistance.

It is yet another object of the present invention to provide a new and useful socket pin for use with sub-cooled electrical components.

It is still a further object of the present invention to provide such socket pin having an increased length and small, hollow, cross section which provides increased thermal resistance.

It is a further object of the present invention to provide such a socket pin including a contact sleeve design which reduces the electrical signal path at the contact sleeve.

SUMMARY OF THE INVENTION

There is provided, in accordance with the present invention, an electronic socket pin for use with sub-cooled integrated circuit devices, the socket pin having a tubular body formed of an electrically conductive material having a low thermal conductance, such as 304 stainless steel. The tubular body is open at one end, and has a first diameter at the open end, for receiving an integrated circuit device signal lead. The remainder of the length of the tubular body has a second diameter which is much narrower than the first diameter. This narrower cross section further reduces the thermal conductance of the electronic socket pin.

The described embodiment of the electronic socket pin also incorporates a unique contact sleeve which improves the electrical signal impedance of the pin. The contact sleeve has a cylindrical body including radially inwardly extending, resilient, prongs formed into the wall of the sleeve. The sleeve is fitted over the open end of the electronic socket pin which includes several longitudinal slots formed into the wall of the socket pin which align with the prongs. When fitted over the end of the socket pin the prongs extend through the slots for engaging an inserted signal lead. The prongs are attached to the lower section of sleeve, away from the open end of the electronic socket pin.

The above and other objects, features, and advantages of the present invention will become apparent from the following detailed specification when read in conjunction with the accompanying drawings in which applicable reference numerals have been carried forward.

DETAILED DESCRIPTION OF THE PREFERRED EMBODIMENT

Figure 2:
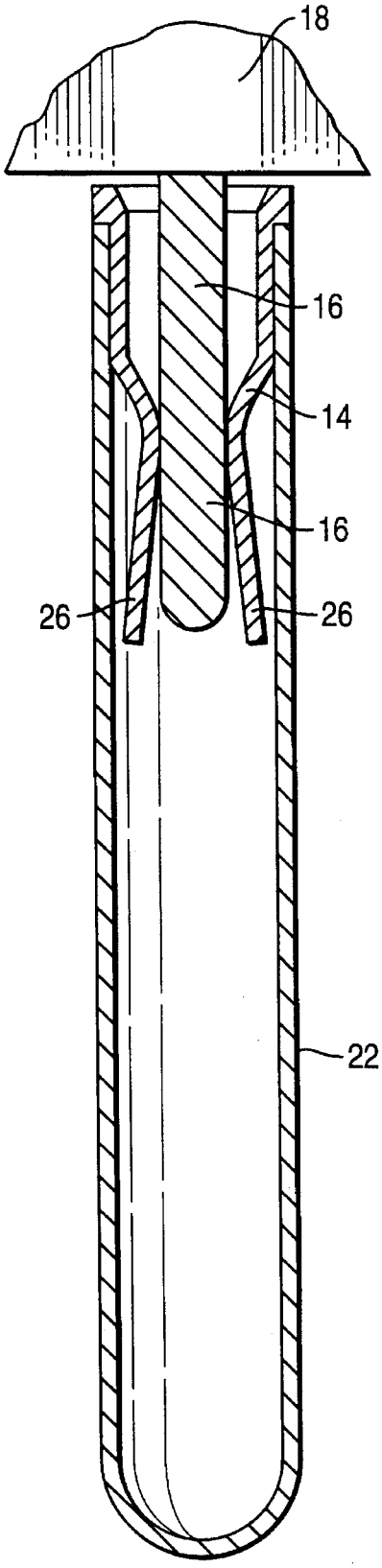
FIG. 2 is h longitudinal sectional view of an improved electronic pin connector constructed in accordance with one form of the present invention.

An improved electronic socket pin formed of stainless steel is shown in FIG. 2. The improved socket pin, shown in a longitudinal sectional view, includes a long tubular body 22, preferably manufactured from plated 304 stainless steel, having an internal diameter which will accept a common contact sleeve 14. The plating of the stainless steel tubular body permits soldering of the socket pin to a printed circuit board. The size and dimensions of the socket pin are determined by the size of the signal pin contact 16 it is designed to mate with. A socket pin having a length of 0.5 and an internal diameter of 0.035 inches throughout its length would accommodate the most common size contact pins utilized with many current IC devices.

Figure 1:
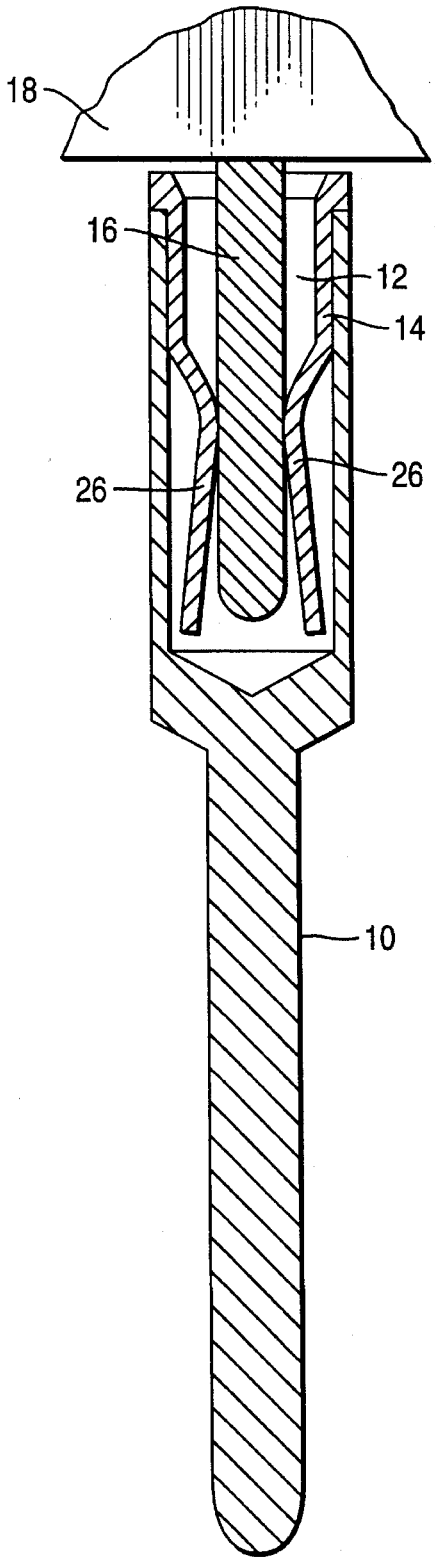
FIG. 1 is a longitudinal sectional view of a typical prior art pin connector.
Figure 4:
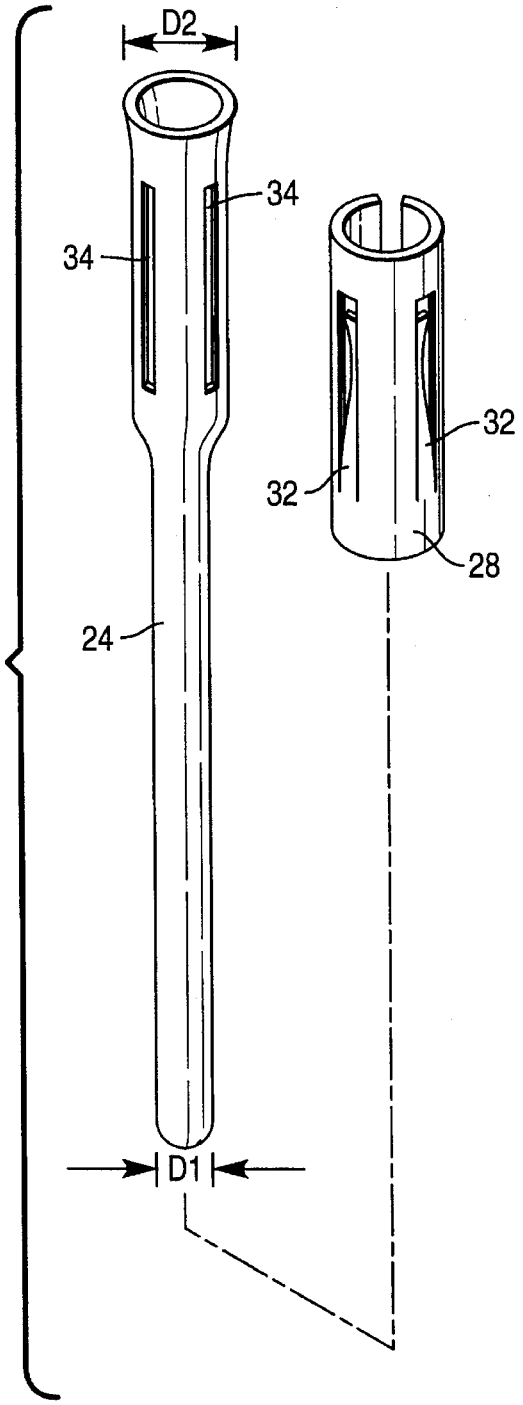
FIG. 4 is an exploded isometric view of the improved pin connector shown in FIG. 3.
Figure 3:
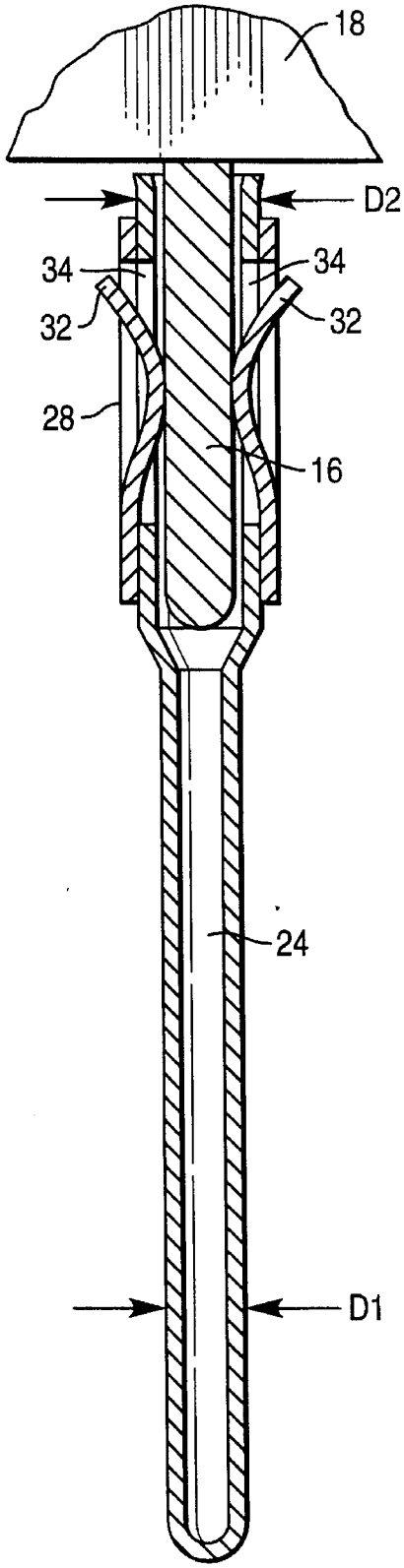
FIG. 3 is a longitudinal sectional view of an improved electronic pin connector constructed in accordance with the preferred form of the present invention.

The thermal resistance of the improved socket pin is increased by manufacturing the pin from a stainless steel or another material having a low thermal conductance. However, thermal resistance can be further increased by extending the length of the socket pin or decreasing the diameter of the socket pin. Accordingly, FIGS. 3 and 4 illustrate a preferred embodiment of the present invention providing greatly improved thermal resistance characteristics in comparison to a typical brass socket pin and the improved electronic pin shown in FIG. 2. The tapered electronic socket pin shown in a longitudinal sectional view in FIG. 3 and in isometric view in FIG. 4, is seen to have a tubular body 24 having a diameter D1 which is much narrower throughout most of its length than a traditional socket pin as well as the improved socket pin shown in FIG. 2. The top end of the tapered socket pin has a greater diameter D2 than the main body of the socket pin. The greater diameter is required for receiving an IC signal contact pin 16.

The tapered electronic socket pin is preferably formed of plated 304 stainless steel having a length of approximately 0.5 inches and a diameter D1 of 0.02 inches O.D. and 0.012 I.D. The thermal resistance of the improved, tapered, electronic socket pin, as shown in FIGS. 3 and 5 through 8, is approximately 2500° C. per watt, significantly greater than the thermal resistance of a typical brass electronic socket pin.

One disadvantage associated with a socket pin including a traditional contact sleeve, is that the signal path between the contact sleeve and the socket pin is made artificially longer by the design of the traditional contact sleeve. Extending the length of the socket pin to increase the thermal resistance of the pin further lengthens the signal path. The extended length of the signal path can increase the signal electrical impedance so much so that IC and circuit board performance can be impacted, especially at high system clock frequencies.

The socket pin shown in FIGS. 3 and 4 includes an improved contact sleeve designed to reduce the length and impedance of the signal path. A traditional contact sleeve consists of a tubular body pressed into the socket end of socket pin. The sleeve body includes several radially inwardly extending, resilient, prongs 26 cut into the wall of the sleeve for engaging an inserted signal contact pin. The improved contact sleeve 28 similarly consists of a tubular body including several radially inwardly extending, resilient, prongs 32 cut into the wall of the sleeve. However, the sleeve 28 is fitted over the socket end of socket pin 24, which includes several longitudinal slots 34 formed into the wall of the socket pin which align with prongs 32, permitting the prongs to extend radially inward into the hollow of the socket pin. Additionally, the prongs are attached to the lower section of sleeve 28, away from the socket end of the electronic socket pin.

Figure 5:
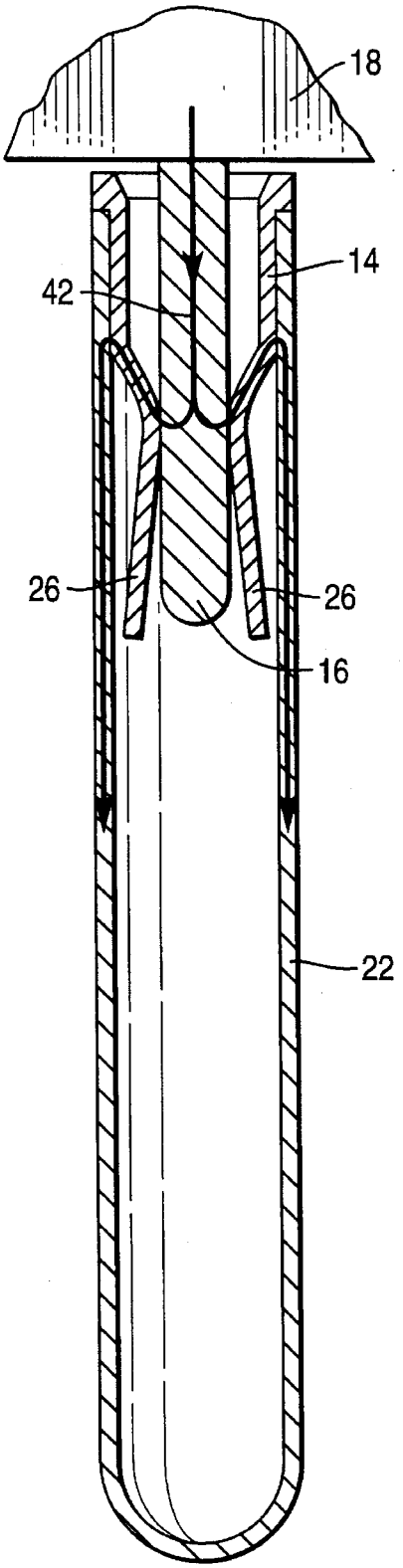
FIG. 5 is a longitudinal sectional view of the improved electronic pin connector of FIG. 2 illustrating the electrical signal path between an integrated circuit device lead and the pin connector.
Figure 6:
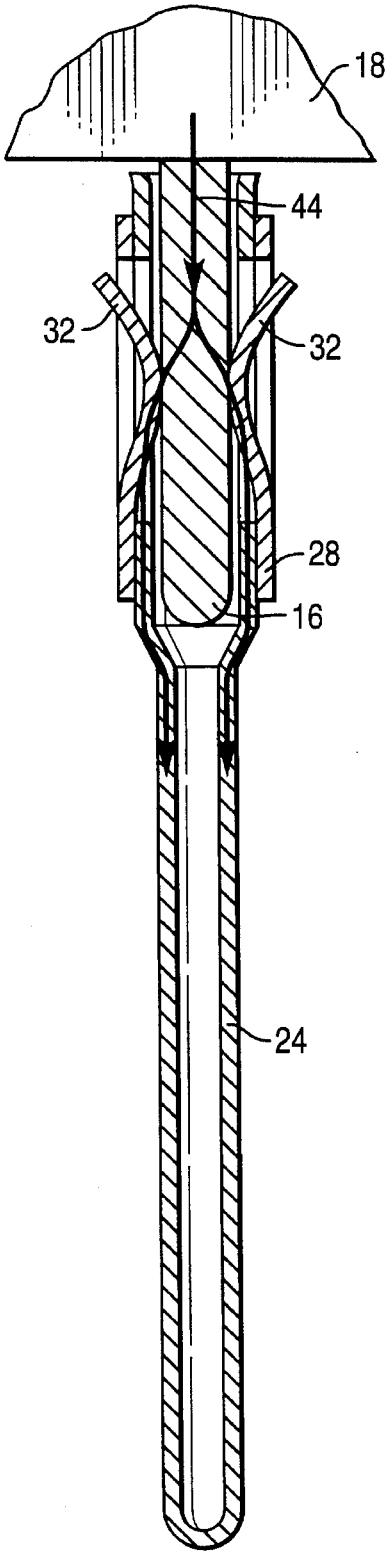
FIG. 6 is a longitudinal sectional view of the improved electronic pin connector of FIG. 3 illustrating the electrical signal path between an integrated circuit device lead and the pin connector.

The reduction in length and impedance of the signal path is illustrated in FIGS. 4 and 5. FIG. 4 is a longitudinal sectional view of an electronic pin connector including a standard contact sleeve. The electrical signal path between an integrated circuit device 18 and printed circuit board, not shown, is identified by reference numeral 42. As shown, the signal path proceeds from integrated circuit device 18, down through signal contact lead 16, upwards through contact sleeve prongs 26 and through the contact sleeve 14 and socket pin body 22 into the printed circuit board.

The signal path 44 for the improved socket pin and contact sleeve design shown in FIGS. 3 and 4 is illustrated in FIG. 5. As shown, signal path 44 proceeds from integrated circuit device 18, down through signal contact lead 16, downwards through contact sleeve prongs 32 and through the contact sleeve 28 and socket pin body 24 into the printed circuit board. As shown, the improved slotted circuit pin design including an external contact sleeve provides a direct signal path of minimal length resulting in lower electrical impedance than standard socket pin and contact sleeve design.

Figure 7:
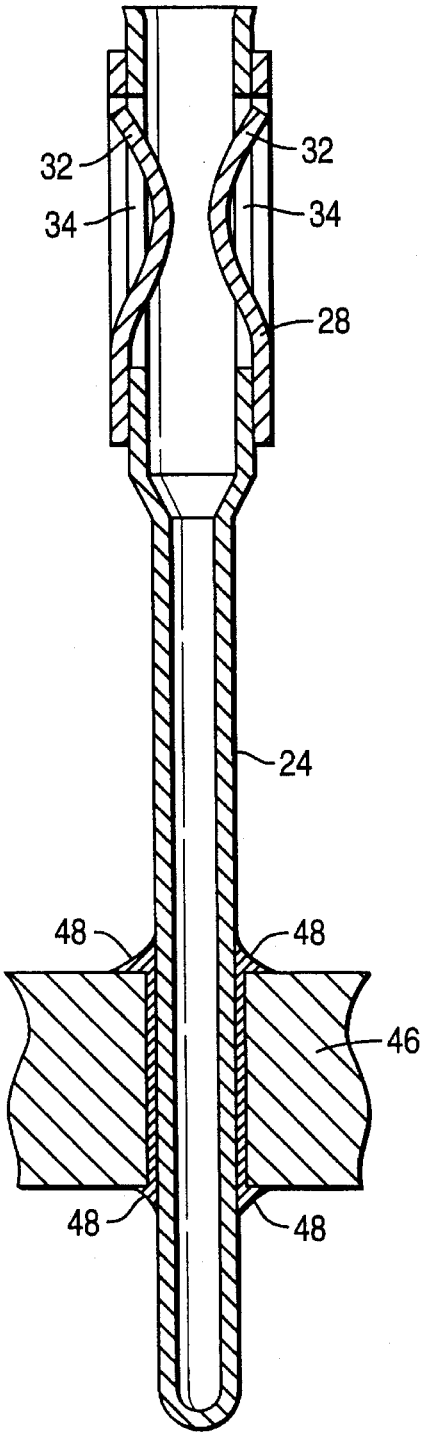
FIGS. 7 and 8 are longitudinal sectional views of the improved electronic pin connector of FIG. 3 showing the pin connector soldered into a printed circuit board.
Figure 8:
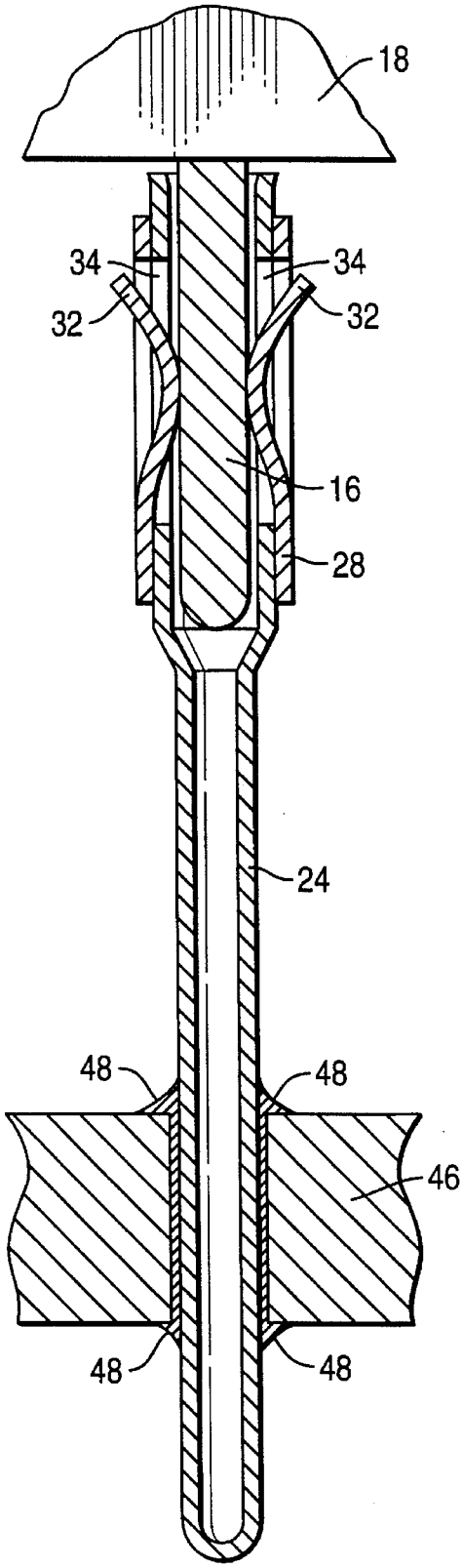

FIGS. 7 and 8 are longitudinal sectional views of the improved electronic pin connector of FIG. 3 showing the pin connector soldered into a printed circuit board 46. Soldering is identified by reference numeral 48. FIG. 7 shows the socket pin and contact sleeve prior to installation of an integrated circuit signal lead, wherein the contact sleeve prongs 32 are seen to protrude radially inward through the slots 34 in the socket pin. FIG. 8 shows the same socket pin following the installation of an IC signal lead 16.

It can thus be seen that there has been provided by the present invention an electronic socket pin for coupling a sub-cooled integrated circuit onto a printed circuit board which provides increased thermal resistance, without a reduction in electrical signal conductance or operating performance. Additionally, the electrical signal path through the socket pin is reduced through the incorporation of an improved contact sleeve over the socket end of the socket pin.

Although the presently preferred embodiment of the invention has been described, it will be understood that various changes may be made within the scope of the appended claims.

What is claimed is:

1. An electronic socket pin, comprising:

an elongated tubular body formed of an electrically conductive material having a low thermal conductance, said tubular body having first section proximate a first end of said tubular body and a second section proximate a second end of said tubular body, said second section of said tubular body having a diameter which is much narrower than said first section;

a socket formed within said first section for receiving a signal lead of an integrated circuit device, said first end of said tubular body being open to receive said signal lead; and a contact sleeve having a cylindrical body including radially inwardly extending, resilient, prongs formed into the wall of said sleeve for engaging an inserted signal lead; wherein:

said sleeve is fitted over the first section of said socket pin which includes several longitudinal slots formed into the wall of the socket pin which align with said prongs, said prongs extending through said slots; and said prongs being attached to said sleeve at a point near the end of said sleeve located further away from the open end of the electronic socket pin.

2. An improved contact sleeve for an electronic socket pin, said contact sleeve comprising:

a cylindrical body including radially inwardly extending, resilient, prongs formed into the wall of the sleeve for engaging an inserted signal contact pin; wherein:

said sleeve is fitted over an open end of said socket pin which includes several longitudinal slots formed into the wall of the socket pin which align with said prongs, said prongs extending through said slots; and said prongs being attached to said sleeve at a point near the end of said sleeve located further away from the open end of the electronic socket pin.

3. An electronic socket pin having improved signal path electrical impedance, said electronics pin comprising:

a tubular body including an open end for mating with an integrated circuit device signal lead;

a contact sleeve having a cylindrical body including radially inwardly extending, resilient, prongs formed into the wall of the sleeve; wherein:

said sleeve is fitted over the open end of said socket pin which includes several longitudinal slots formed into the wall of the socket pin which align with said prongs, said prongs extending through said slots for engaging said signal lead; and said prongs being attached to said sleeve at a point near the end of said sleeve located further away from the open end of the electronic socket pin.

4. The electronic socket pin according to claim 3, wherein:

said tubular body has a first diameter at said open end large enough for receiving said integrated circuit device signal lead; and the remainder of the length of said tubular body has a second diameter which is narrower than said first diameter.

5. The electronic socket pin according to claim 4, wherein:

said electronic socket pin has a length of approximately 0.5 inches; and said second diameter is approximately 0.02 inches O.D. and 0.12 I.D.

6. The electronic socket pin according to claim 3, wherein said tubular body is formed from a material having high thermal conductance.

7. The electronic socket pin according to claim 6, wherein said electrically conductive material comprises 304 stainless steel.

8. The electronic socket pin according to claim 6, wherein said stainless steel body is plated to permit soldering of said electronic socket pin to a printed circuit board.

* * * * *